United States Patent [19]

Kamijyo

[11] Patent Number: 5,040,474

[45] Date of Patent: Aug. 20, 1991

[54] SEWING MACHINE INCLUDING MEANS FOR CORRECTING A TARGET MEMORY IN RESPONSE TO DETECTION OF X-Y FRAME POSITION

[75] Inventor: Tsuyoshi Kamijyo, Toyota, Japan

[73] Assignee: Aisin Seiki Kabushiki Kaisha, Kariya, Japan

[21] Appl. No.: 499,900

[22] Filed: Mar. 27, 1990

[30] Foreign Application Priority Data

Mar. 31, 1989 [JP] Japan ..... 1-83346

[51] Int. Cl.[5] ..... D05B 21/00

[52] U.S. Cl. ..... 112/121.12; 112/262.3; 112/277

[58] Field of Search ..... 112/121.12, 121.11, 112/102, 103, 275, 277, 266.1, 262.3; 364/470

[56] References Cited

U.S. PATENT DOCUMENTS

| | | | |
|---|---|---|---|
| 4,457,242 | 7/1984 | Nordstrom | 112/121.12 |
| 4,688,498 | 8/1987 | Carlson | 112/121.12 X |
| 4,936,233 | 6/1990 | Tajima et al. | 112/121.12 X |

*Primary Examiner*—Peter Nerbun

*Attorney, Agent, or Firm*—Banner, Birch, McKie & Beckett

[57] ABSTRACT

Sewing machine for stitching operation capable of correcting an amount of movement of a stepping motor when its movement is restricted and further capable of performing a stitching operation at an original specified position.

15 Claims, 7 Drawing Sheets

SEWING MACHINE INCLUDING MEANS FOR CORRECTING A TARGET MEMORY IN RESPONSE TO DETECTION OF X-Y FRAME POSITION

BACKGROUND OF THE INVENTION

1. Field of the Invention

This invention relates to a sewing machine for stitching operation, and more particularly a sewing machine for stitching operation including a frame to be moved in X-axis and Y-axis directions.

2. Description of the Related Art

As this type of prior art sewing machine for stitching operation, it is possible to apply a technology described in Japanese Laid-Open Patent Publication No. Sho 63-283694.

The technology described in this gazette is operated such that the stitching frame is moved by a stepping motor in an X-axis direction and a Y-axis direction so as to perform a predetermined stitching operation in response to a digital signal received from an external controller.

However, the prior art sewing machine for stitching operation had a stepping motor for facilitating its digital processing and its driving torque was not so high. That is, even though there is no trouble in a normal stitching operation, a movement of the stitching frame in respect to X-axis direction or Y-axis direction is restricted if there are some obstacles on an upper part of a base and there is a possibility that its stitching operation is displaced during the stitching operation. In addition, even in case that a voltage is dropped during a stitching operation, there is a possibility that stitching position of the stitching frame is displaced. In this way, if a stitching position was displaced, its influence caused by the displaced position could not eliminated.

SUMMARY OF THE INVENTION

In view of the foregoing, it is an object of the present invention to provide a sewing machine for stitching operation capable of correcting an amount of movement when a movement of a stepping motor is restricted and further capable of performing a stitching operation at its original specified position.

As described above, the sewing machine for stitching operation of this invention is comprised of a stepping motor for moving the stitching frame in the X-axis direction and the Y-axis direction; an encoder arranged at the shaft of the stepping motor; a home position switch for detecting reference positions of the stitching frame in the X-axis direction and the Y-axis direction; a target memory for storing target positions in the X-axis direction and the Y-axis direction for moving the stitching frame; a counter for calculating output signal of the X-axis encoder and the Y-axis encoder and expressing an actual position of the stitching frame; and a correcting means for calculating a difference between the value of the target memory and the value of the counter and correcting the content of the target memory in reference to the corrected value.

Accordingly, when a displacement in movement of the stitching frame is generated by the stepping motor due to a presence of the obstacles or a voltage drop and the like, the difference between the value of the target memory and the value of the counter can be calculated and the content of the target memory which constitutes stitching position data can be corrected, so that even if the displacement in movement of the stitching frame is generated, influence caused by this displacement can be corrected.

Preferably, the correction of this invention is operated such that a difference between the value of the target memory and the value of the counter is calculated, the content of the target memory is corrected in reference to the corrected value and a switch operation is applied for discriminating whether a continuous operation is performed or not, so that even if a displacement is generated during the stitching operation, its degree of displacement can be confirmed and the stitching operation can be continued. In addition, influence of displacement in position can be discriminated at an early time and further there is no occurrence that the stitching thread must be released upon completion of the stitching operation.

BRIEF DESCRIPTION OF THE ACCOMPANYING DRAWINGS

DESCRIPTION OF THE PREFERRED EMBODIMENT

Figure 1:
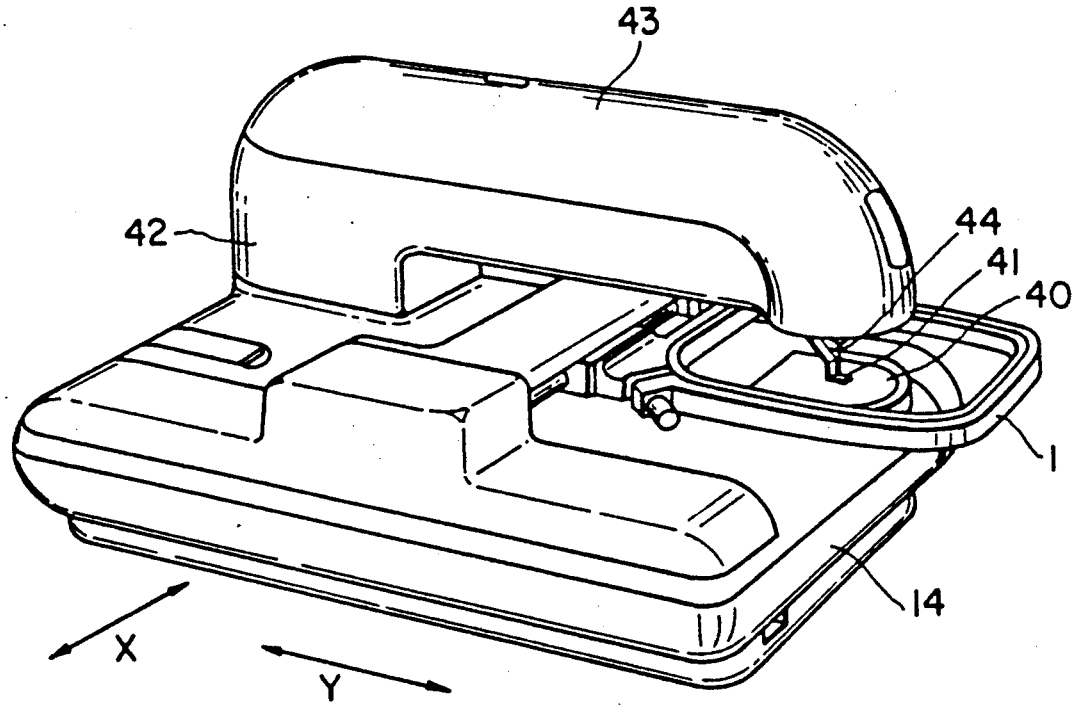
FIG. 1 is a perspective view for showing an entire sewing machine for stitching operation of one preferred embodiment of the present invention.

Referring now to the drawings, one preferred embodiment of the present invention will be described.

Figure 2:
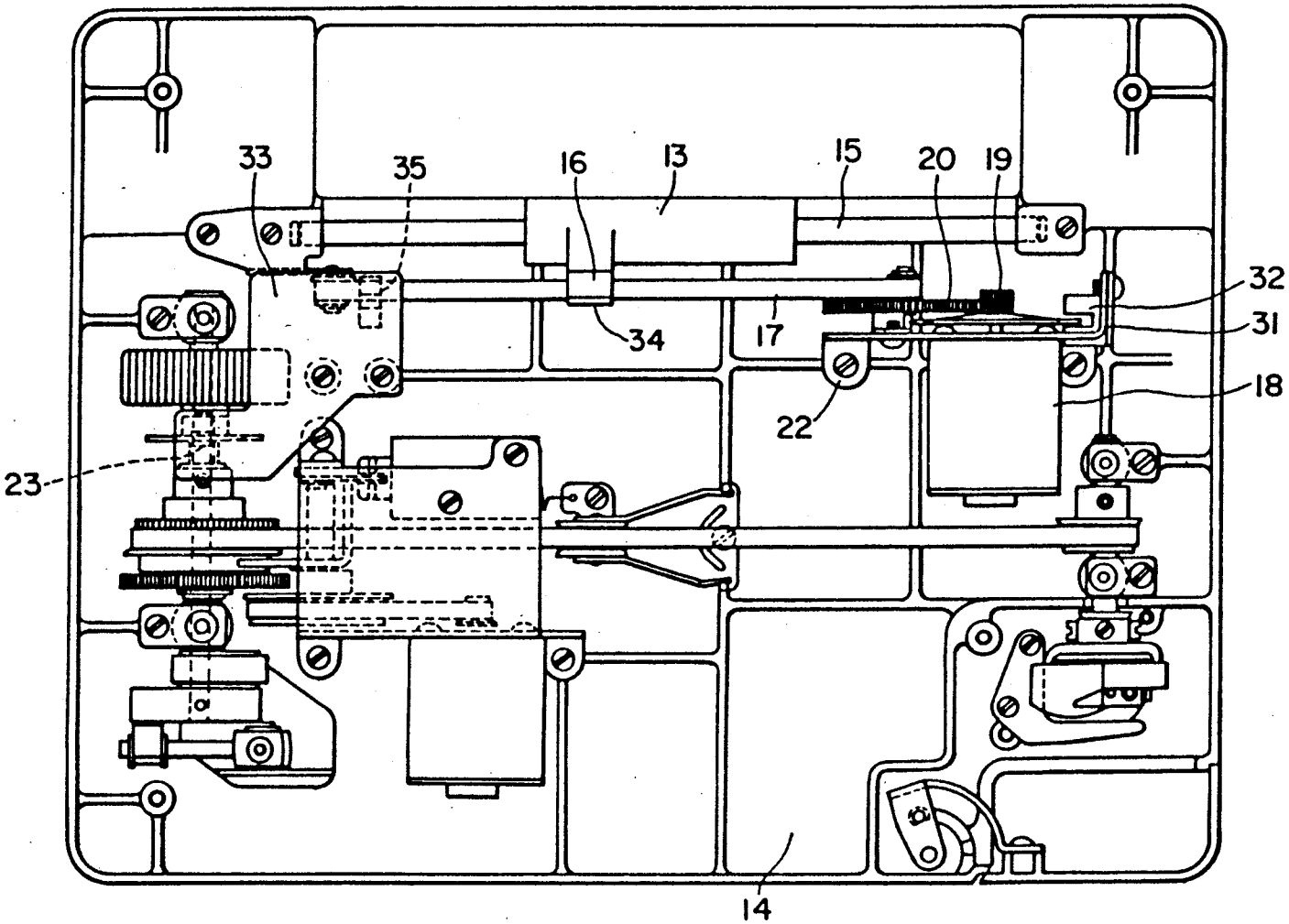
FIG. 2 is a bottom view for showing a case in which a bed cover of a sewing machine for stitching operation of one preferred embodiment of the present invention.
Figure 3:
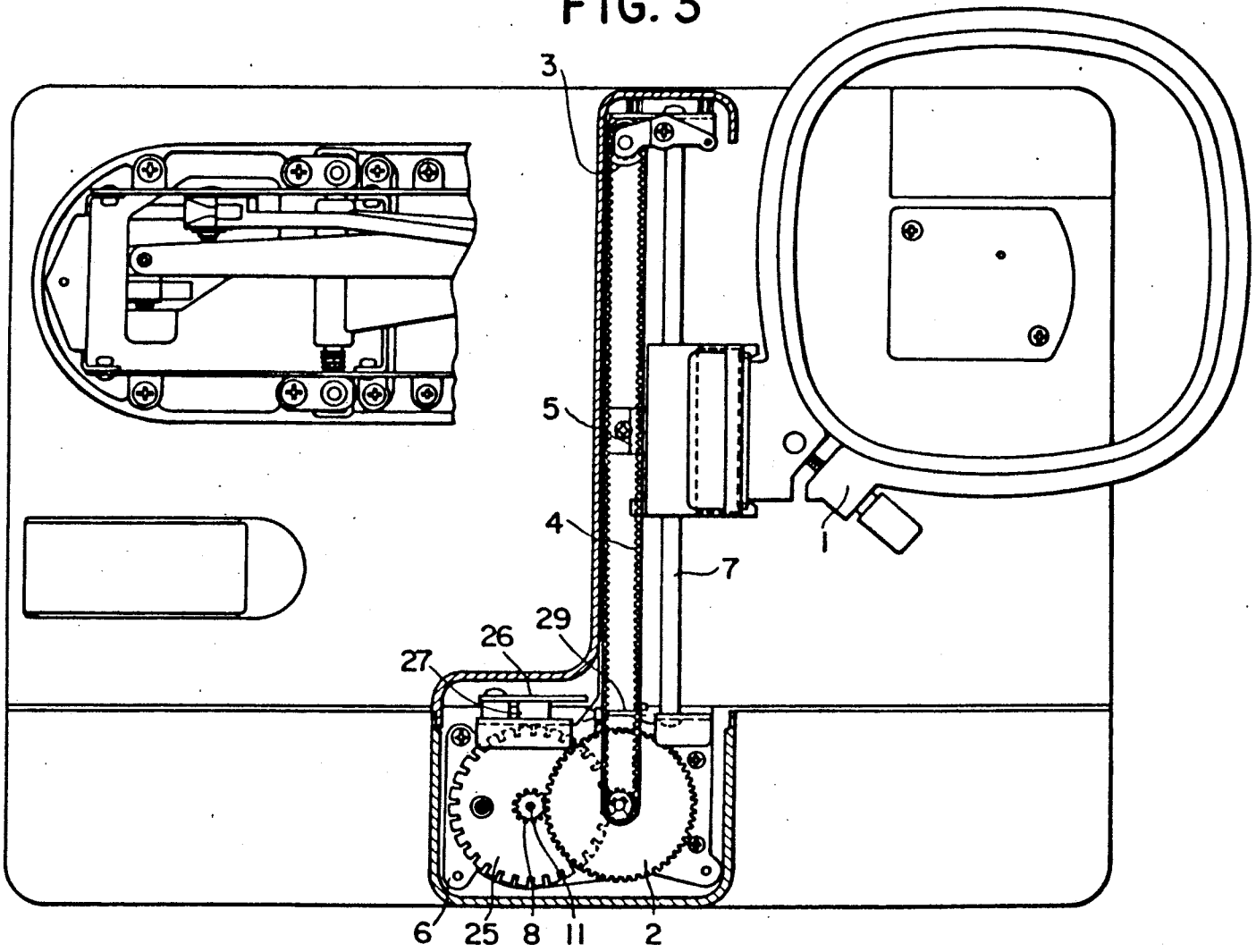
FIG. 3 is a substantial sectional view for showing a structure as viewed in an X-axis direction of the sewing machine for stitching operation of one preferred embodiment of the present invention.
Figure 4:
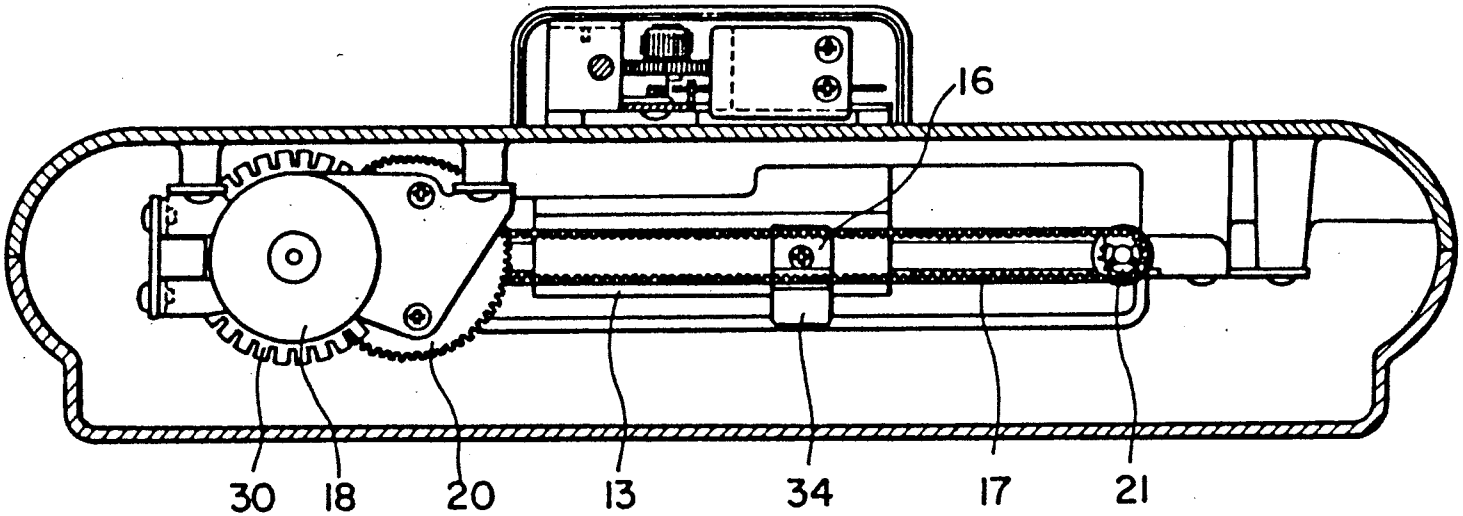
FIG. 4 is a substantial sectional view for showing a structure in an Y-axis direction of the sewing machine for stitching operation of one preferred embodiment of the present invention.

FIG. 1 is a perspective view for showing an entire sewing machine for stitching operation of one preferred embodiment of the present invention. FIG. 2 is a bottom view for showing a case in which a bed cover of a sewing machine for stitching operation of one preferred embodiment of the present invention is removed. FIG. 3 is a substantial sectional view for showing a structure in an X-axis direction of a sewing machine for stitching operation of one preferred embodiment of the present invention. FIG. 4 is a substantial sectional view for showing a structure in an Y-axis direction of a sewing machine for stitching operation of one preferred embodiment of the present invention.

As illustrated in a perspective view of FIG. 1, an outer appearance of a sewing machine for stitching operation of one preferred embodiment of the present invention is comprised of a base 14 having at its upper surface a needle plate 40 and a needle through-pass hale 41 punched in the needle plate 40, a needle rod having a needle 44 at an end part of the base 14 and having an arm housing 42 with a needle rod arm stored therein, a top cover 43 and a stitching frame 1 moved in parallel along X-axis direction and Y-axis direction on the upper surface of the base 14.

The stitching holder 1 has an X-axis shaft 7 fitted to an X-axis motor bracket 6 and it is fixed to an X-axis timing belt 4 by an X-axis timing belt holder 5. As an X-axis stepping motor 11 is rotated, the stitching holder 1 is moved in parallel along a vertically extending X-axis shaft 7 in FIG. 3 by an X-axis gear 8 fitted to the X-axis stepping motor 11, an X-axis timing pulley 2 and an X-axis timing belt 4 arranged in tension between the X-axis timing pulley 2 and the X-axis idle pulley 3.

The X-axis motor bracket holder 13 has an Y-axis shaft 15 fixed to the base 14 and further fixed to the Y-axis timing belt 17 by an Y-axis motor timing belt holder 16. As the Y-axis stepping motor 18 fixed to the Y-axis motor bracket 22 fixed to the base 14 by a small screw and the like is rotated, the Y-axis motor gear 19 fixed to the Y-axis stepping motor 18 and the Y-axis timing pulley 20 are rotated, and the Y-axis motor timing belt holder 16 is moved in parallel along the Y-axis shaft 15 by the Y-axis timing belt 17 mounted in tension between the Y-axis timing pulley 20 and an Y-axis idle pulley 21.

Figure 5:
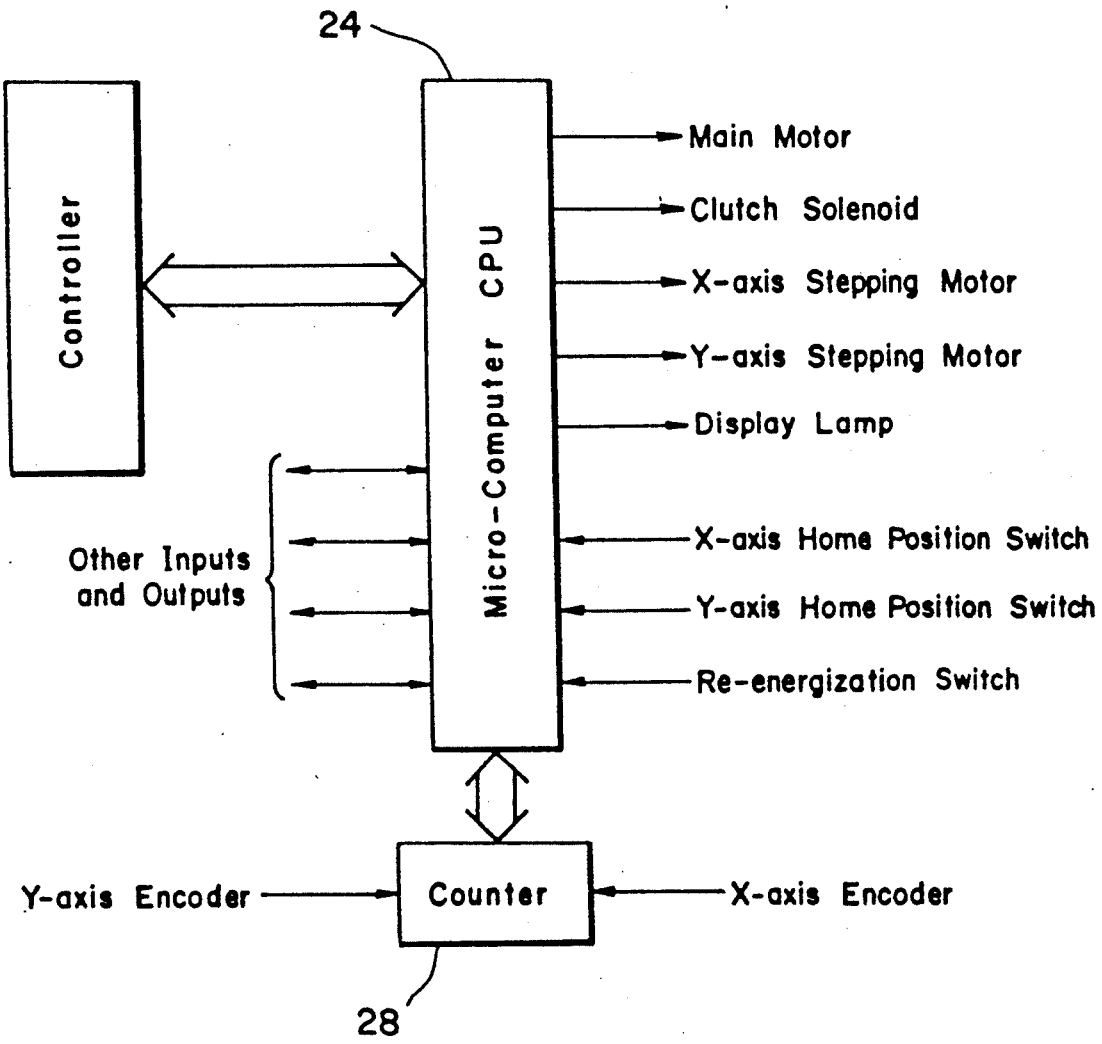
FIG. 5 is a schematic configuration of a control device for the sewing machine for stitching operation for controlling the sewing machine for stitching operation of one preferred embodiment of the present invention.

The X-axis stepping motor 11 and Y-axis stepping motor 18 are independently driven by a pulse outputted from a microcomputer 24 shown in FIG. 5 in synchronous with a signal from a needle sensor 23.

An X-axis rotary encoder disk 25 shown in FIG. 3 is fixed to a shaft of the X-axis stepping motor 11. An X-axis photo interrupter base plate 26 is fixed to the X-axis motor bracket 6 so as to hold the above-mentioned X-axis rotary encoder disk 25 between a light receiving part and a light emitting part of a photo-interrupter 27. The X-axis rotary encoder disk 25, X-axis photo-interrupter base plate 26 and the photo-interruptor 27 constitute the X-axis rotary encoder. A signal from the photo-interrupter 27 is inputted to a counter 28 shown in FIG. 5.

When the stitching frame holder 1 is moved to the right end as viewed in the figure, the X-axis home position switch 29 is pushed by a side surface of the stitching frame holder 1 and fixed to the X-axis motor bracket 6 in such a way as its contact point may contact with it. When the stitching frame holder 1 is moved to a right deep end as viewed in FIG. 1, the X-axis home position switch 29 is pushed by a side surface of the stitching frame holder 1 and fixed to the X-axis motor bracket 6 in such a way as a contact point may contact with it. A signal from this X-axis home position switch 29 is inputted to the micro-computer 24 in FIG. 5. Similarly, the Y-axis rotary encoder disk 30 is fixed to a shaft of the Y-axis stepping motor 18. The Y-axis photo-interrupter base plate 31 is fixed to the Y-axis motor bracket 22 so as to hold the above-mentioned Y-axis rotary encoder disk 30 between the light receiving part and the light emitting part of the photo-interruptor 32. The Y-axis rotary encoder disk 30, the Y-axis photo-interrupter base plate 31 and the photo-interrupter 32 may constitute the Y-axis rotary encoder.

A signal from the photo-interrupter 32 is inputted to the counter 28 in FIG. 5. The Y-axis home position sensor base plate 33 is fixed to the base 14 in such a way as a light shielding plate 34 fixed to the Y-axis motor timing belt holder 16 fitted to the Y-axis timing belt 17 is moved to a right end as viewed in the figure and held between the light receiving part and the light emitting part of the Y-axis home position switch 35. A signal of the Y-axis home position switch 35 is inputted to the micro-computer 24 shown in FIG. 5. The micro-computer 24 and the counter 28 are directly connected by a counted value resetting line, a counted value output request signal line and a counted value output line.

FIG. 5 is a schematic configuration of a control device for a sewing machine for stitching operation for use in controlling the sewing machine for stitching operation of one preferred embodiment of the present invention.

The above-mentioned micro-computer 24 may receive data for stitching operation from a controller such as an external personal computer and the like. The micro-computer 24 has at its output ports a main motor for driving the needle 44, a clutch solenoid for aligning an operation timing between a rotating hook (not shown) and the needle 44, the X-axis stepping motor 11 comprised of a pulse motor, the Y-axis stepping motor 18 similarly comprised of a pulse motor and a display lamp and the like for displaying the fact that a movement of the stitching frame 1 is displaced and the like.

The micro-computer 24 has some inputs of signals from the X-axis rotary encoder including the X-axis rotary encoder disk 25, the X-axis photo-interrupter base plate 26 and the photo-interruptor 27; some signals from the Y-axis rotary encoder including the Y-axis rotary encoder disk 30, the Y-axis photo-interrupter base plate 31 and the photo-interrupter 32; some signals from the X-axis home position switch 29; some signals from the Y-axis home position switch 35; and some signals from a reenergization switch manually operated to continue a stitching operation when a cause of positional displacement is eliminated and the like.

In addition, the micro-computer 24 has some inputs of sensors for detecting a releasing of the top cover in the sewing machine for stitching operation, a cut thread, a releasing of a rotating hook and an upper needle and the like.

Figure 6:
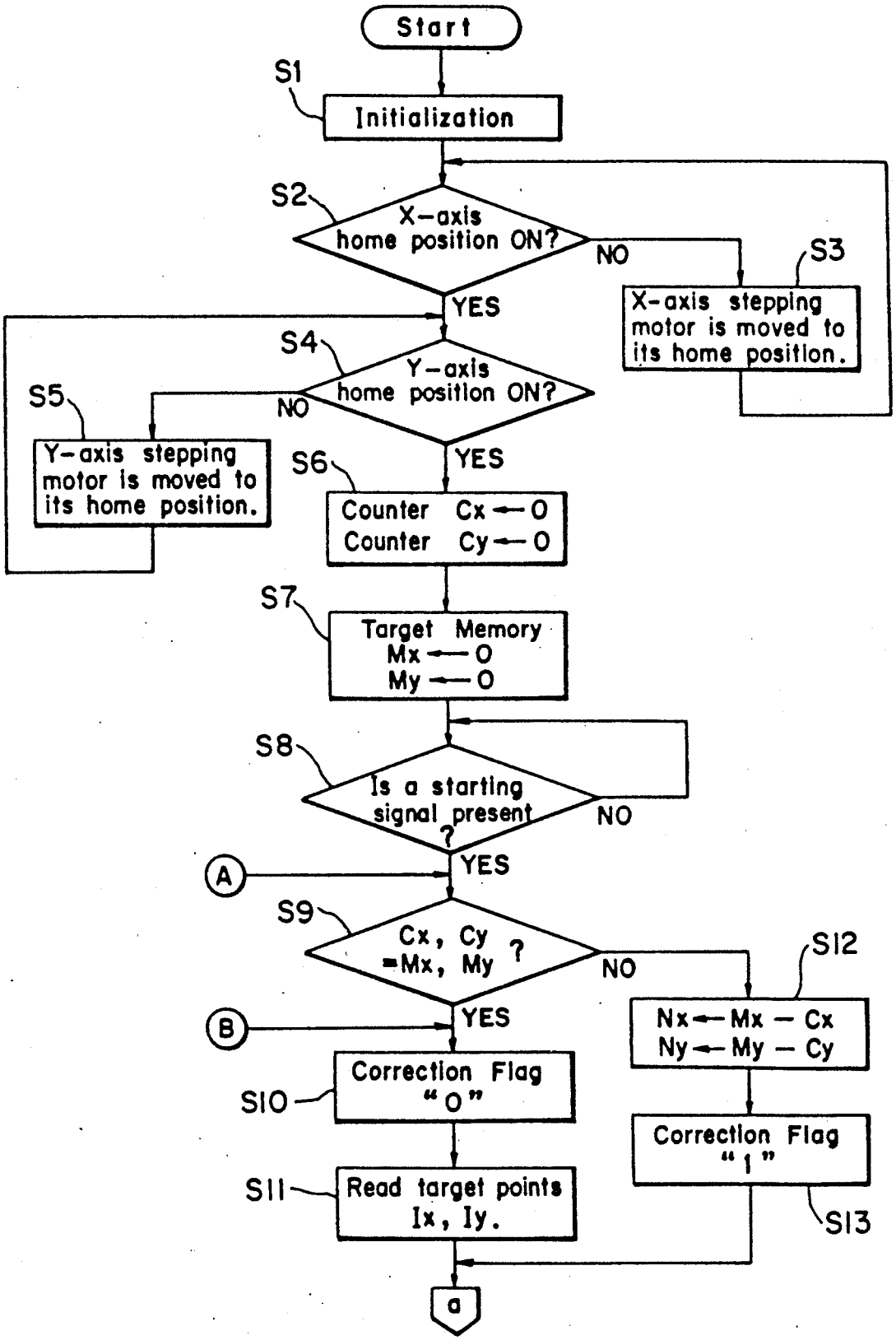
FIGS. 6 and 7 are a control flow chart for the sewing machine for stitching operation of one preferred embodiment of the present invention.
Figure 7:
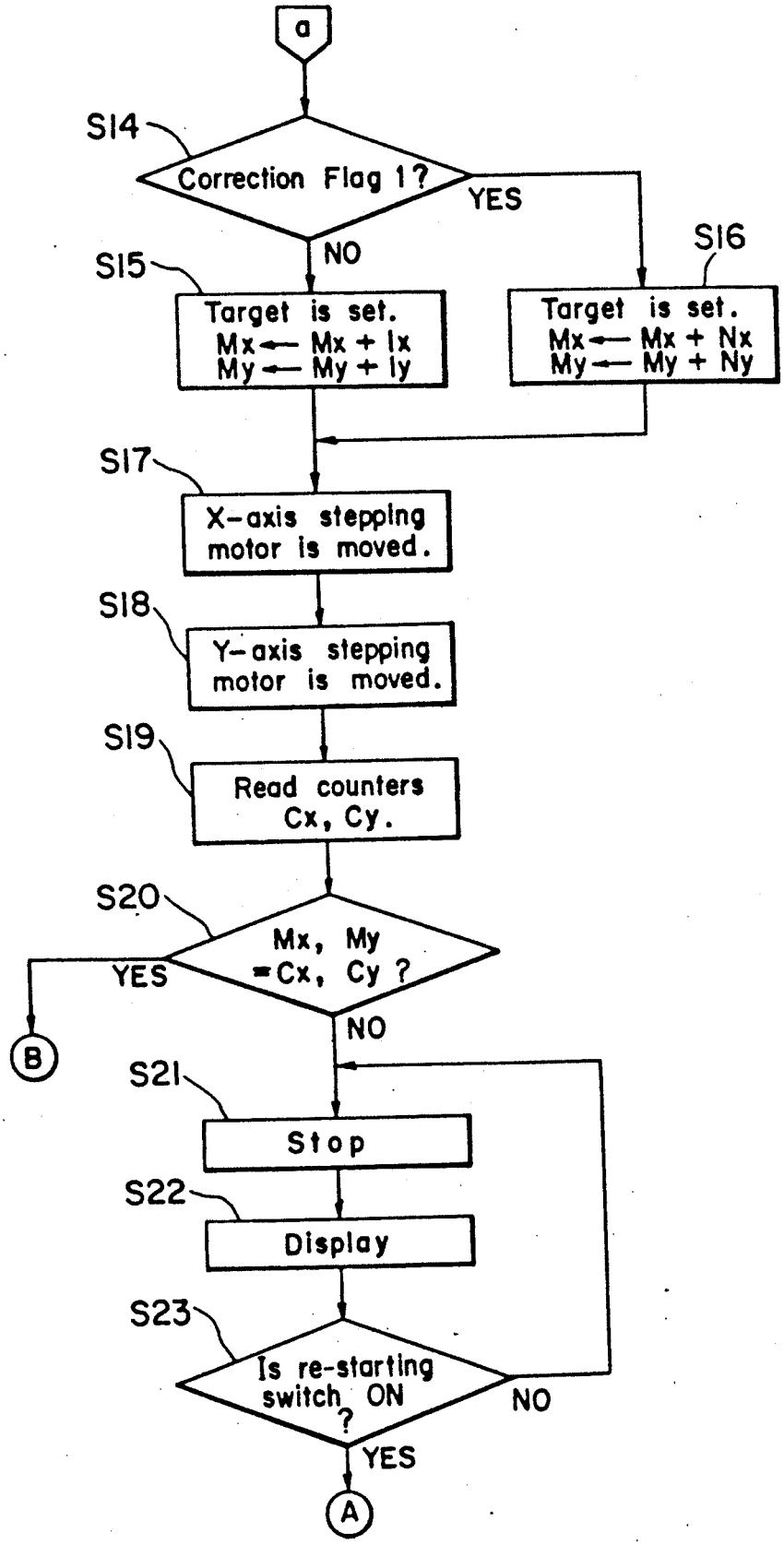

The sewing machine for stitching operation of the present invention constructed as above will be controlled as shown in FIGS. 6 and 7.

FIGS. 6 and 7 illustrate a flow chart for controlling a sewing machine for stitching operation of one preferred embodiment of the present invention.

At first, an initialization of a memory required for performing a program and an initialization of a counter and an output port and the like are set at a step S1. At a step S2, it is discriminated if the X-axis home position switch 29 is ON and when the X-axis home position switch 29 is not ON, the X-axis stepping motor 11 is rotated at a step S3 and then the stitching frame 1 is moved to the home position. When it is discriminated that the X-axis home position switch 29 is ON at the step S2, it is discriminated if the Y-axis home position switch 35 is ON at the step S4. When the Y-axis home position switch 35 is not ON, the Y-axis stepping motor 18 is moved to the home position at the step S5. When it is judged that the Y-axis home position switch 35 is ON at the step S4, the X-axis counter Cx is set to "0" and the Y-axis counter Cy is set to "0" at the step S6. Then, the X-axis target memory Mx as a stitching position data is set to "0" and the Y-axis target memory My is set to "0" at the step S7. When a starting signal for data of stitching is discriminated from a controller such as a personal computer at the step S8 and an arrival of the starting signal is confirmed, the step S9 judges if the values of the X-axis counter Cx and the Y-axis counter Cy are equal to the X-axis target memory Mx for the stitching position data and the target memory My for the Y-axis or not. That is, in this case, it is judged that the values of the X-axis target memory Mx and the Y-axis target memory My having the target position of the stitching frame 1 set are equal to the X-axis counter Cx and the Y-axis counter Cy having an actual position of the stitching frame 1, i.e. it is judged if the stitching frame 1 has no displacement. At first, the operation enters this routine, since the values of the X-axis target memory Mx and the Y-axis target memory My, the values of the X-axis counter Cx and the Y-axis counter Cy are "0" to each other, a correction flag meaning that it not necessary to have any correction at the step S10 is set to "0" and then at the step S11, stitching data Ix and Iy are read from a controller such as a personal computer at the step S11.

In addition, when the value of the X-axis counter Cx and the value of the Y-axis counter Cy are not equal to the values of the X-axis target memory Mx and the Y-axis target memory My acting as stitching position data, the X-axis counter Cx is subtracted from the X-axis target memory Mx at the step S12 and its result is stored as the correction value Nx. The Y-axis counter Cy is subtracted from the Y-axis target memory My, and its result is stored as the correction value Ny. In this case, the values of the corrected values Nx and Ny denote a size of displacement and a displacement direction between an actual position of the stitching frame 1 and its target position. Then, at the step S13, the correction flag is set to "1" and an occurrence of displacement is stored.

At the step S14, it is judged if the correction flag is "1" and when the correction flag is not "1", i.e. when the stitching frame 1 reaches the target position, the stitching data Ix and Iy read at the step S11 are added to the values of the X-axis target memory Mx and the Y-axis target memory My and then they are applied as the value of the target memories Mx and My. When the correction flag is "1" at the step S14, that is, when the stitching frame 1 does not reach the target position and a correction is needed, the correction value Nx is added to the target memory Mx of the X-axis and this value is set as a new X-axis target memory Mx, i.e. $Mx \leftarrow Mx + Nx$. Simultaneously, the correction value Ny is added to the Y-axis target memory My and this value is set as the Y-axis target . memory My, that is, $My \leftarrow My + Ny$.

Then, at the step S17, the X-axis stepping motor 11 is driven by the X-axis target memory Mx, and at the step S18, the Y-axis stepping motor 18 is driven by the Y-axis target Memory My, then the stitching frame 1 is moved to its target position.

Then, at the step S19, the values of the X-axis counter Cx and the Y-axis counter Cy corresponding to the actual moved distance are read, and at the step S20, it is judged if the values of the X-axis counter Cx and the Y-axis counter Cy are equal to the values of the X-axis target memory Mx and the Y-axis target memory My. That is, at the present time, it is judged if the values of the x-axis target memory Mx and the Y-axis target memory My for which the stitching frame 1 is to be moved are equal to the values of the X-axis counter Cx and the Y-axis counter Cy indicating the actual position of the stitching frame 1 and if there is no displacement in the stitching frame 1. When the values of the X-axis counter Cx and the Y-axis counter Cy are equal to the values of the X-axis target memory Mx and the Y-axis target memory My and when it is not acknowledged that there is a displacement of the stitching frame 1, the routine ranging from the step S10 to the step S20 is repeatedly run.

When it is judged that the values of the X-axis counter Cx and the Y-axis counter Cy are not equal to the values of the X-axis target memory Mx and the Y-axis target memory My at the step S20, the system is stopped at the step S21 and then it is displayed by the display lamp that there is a displacement at the step S22 and stopped. This state is continued until the reenergization switch is operated at the step S23. That is, an operator judges that a displacement is generated and the system is stopped, and the operator acknowledges a degree of the displacement, resulting in that its cause is eliminated and the stitching operation may be continued and the stitching operation is restarted by operating the restarting switch. At this time, the operation is carried out through a correction routine comprised of the steps S9, S12, S13, S14 and S16.

In this way, the sewing machine for stitching operation of the preferred embodiment of the present invention is comprised of the X-axis stepping motor 11 for moving the stitching frame 1 in an X-axis direction; an X-axis encoder arranged at the X-axis stepping motor 11; the X-axis home position switch 29 for sensing a reference position of the stitching frame 1 in an X-axis direction; the Y-axis stepping motor 18 for moving the stitching frame 1 in an Y-axis direction; the Y-axis encoder arranged at the shaft of the Y-axis stepping motor 18; the Y-axis home position switch 35 for sensing a reference position of the stitching frame 1 in the Y-axis direction; the target memories Mx and My for reading the stitching data Ix and Iy in the X-axis direction and the Y-axis direction for moving the stitching frame 1 and storing the data after their correction, if necessary; the counters (28)Cx and Cy to cause the moving direction in the X-axis direction and the Y-axis direction driven in reference to the content of the target memories Mx and My to be output signals of the X-axis encoder and the Y-axis encoder and count them; and a correcting means comprised of a routine ranging from the steps S9 to S16 for calculating the difference between the values of the target memories Mx and My and the counters Cx and Cy and correcting the content of the target memories Mx and My as the correction values.

Accordingly, the stitching data Ix and Iy are read from the controller such as a personal computer and the like, the X-axis stepping motor 11 and the Y-axis stepping motor 18 are rotated in response to the X-axis target memory Mx and the Y-axis target memory My in reference to the stitching data Ix and Iy and then the stitching frame 1 is moved to its predetermined position. Movement of the stitching frame 1 is processed such that the number of pulses corresponding to the actual moved distance of the stitching frame is generated by the X-axis encoder arranged at the shaft of the X-axis stepping motor 11 and the Y-axis encoder arranged at the shaft of the Y-axis stepping motor 18, the number of pulses is counted by the counters Cx and Cy, the X-axis counter Cx corresponding to the actual moved distance is subtracted from the X-axis target memory Mx to provide a correction value Nx, the Y-axis counter Cy corresponding to the actual moved distance is subtracted from the Y-axis target memory My as the stitching position data, then the taken X-axis target memory Mx and Y-axis target memory My are corrected as its correcting value Ny, thereby the X-axis target memory Mx and Y-axis target memory My acting as the next stitching data are set as corrected values and thus a stitching operation is carried out. Thus, when the X-axis target memory Mx and the Y-axis target memory My for a moving distance through stitching data are not coincided with the actual movement, the X-axis memory My for a moving distance through stitching data are not coincided with the actual movement, the X-axis stepping motor 11 and the Y-axis stepping motor 18 may correct the next stitching data and at the same time the operation is terminated by a routine ranging from the step S21 to S23, resulting in that the operator may confirm the state of stitching and judge a continuation of operation, the displacement can be accommodated only with its stitching position and its influence may not be applied to other factors.

Although in the above-mentioned preferred embodiment, the step S20 judges if the values of the X-axis target memory Mx and the Y-axis target memory My of the stitching data are equal to the values of the actually moved X-axis counter Cx and the Y-axis counter Cy, it may also be applicable that it may be judged if they are within a predetermined allowable error range. In other words, the judgement on the reenergization switch of the step S23 can be substituted for a judgement if the values of the X-axis target memory Mx and Y-axis target memory My as well as the values of the actually moved X-axis counter Cx and the Y-axis counter Cy are within the predetermined allowable error range.

Although the X-axis home position switch 29 and the Y-axis home position switch 35 for use in detecting a reference position of the stitching frame in an X-axis direction in the preferred embodiment above is a contact switch and an adjoining switch, any one of the X-axis home position switch 29 and the Y-axis home position switch 35 in case of carrying out the present invention may be selected.

Although the preferred embodiment of the present invention has been described by limiting it to the sewing machine for stitching operation, the technology of the present invention can be used in a device having X-axis and Y-axis which are driven by a stepping motor.

What is claimed is:

1. A sewing machine for stitching operation comprising:

an X-axis stepping motor for moving a stitching frame in an X-axis direction, an X-axis encoder arranged at a shaft of said X-axis stepping motor, and an X-axis home position switch for sensing a reference position of the stitching frame in the X-axis direction;

a Y-axis stepping motor for moving the stitching frame in a Y-axis direction, a Y-axis encoder arranged at a shaft of said Y-axis stepping motor, and a Y-axis home position switch for sensing a reference position of the stitching frame the Y-axis direction;

a needle sensor associated with said X-axis stepping motor and said Y-axis stepping motor, and said X-axis stepping motor and said Y-axis stepping motor being driven synchronously with a signal from said needle sensor;

a target memory for storing target positions in the X-axis direction and the Y-axis direction for moving the stitching frame;

a counter for counting output signals from the X-axis encoder and the Y-axis encoder and expressing the actual position of the stitching frame; and a correcting means for calculating a difference between the values of said target memory and the counter and correcting the content of said target memory in reference to its calculated difference.

2. A sewing machine having a system for controlling the sewing machine during a stitching operation, said system comprising:

an X-axis motor for moving a stitching frame in an X-axis direction, an X-axis sensor for sensing the actual position of the stitching frame, and an X-axis memory for receiving and storing X-axis target data for directing the movement of the stitching frame in an X-axis direction;

a Y-axis for moving the stitching frame in a Y-axis direction, a Y-axis sensor for sensing the actual position of the stitching frame, and a Y-axis memory for receiving and storing Y-axis target data for directing the movement of the stitching frame in a Y-axis direction; and a processing unit for comparing the actual position of the stitching frame with the target data repeatedly during the stitching operation and stopping the stitching operation when a deviation between the target data and the actual position of the stitching frame is encountered to permit correction of the position of the stitching frame.

3. A sewing machine having a system as set forth in claim 2, wherein said processing unit further includes correcting means for calculating a difference between a position indicated by said target data in said X-axis and Y-axis memories and the actual position as sensed by the X-axis and Y-axis sensors and correcting the target data in said X-axis and Y-axis memories as necessary in accordance with the calculated difference.

4. A sewing machine having a system as set forth in claim 3, which further includes an X-axis home position and a Y-axis home position switch for sensing a reference position for the stitching frame in the X-axis and Y-axis directions, respectively.

5. A sewing machine having a system as set forth in claim 2, which further includes an X-axis home position switch and a Y-axis home position switch for sensing a reference position for the stitching frame in the X-axis and Y-axis directions, respectively.

6. A sewing machine comprising:

a stitching frame for holding material to be stitched;

means for stitching the material;

an X-axis motor for moving the stitching frame in the X-axis direction;

an X-axis encoder for monitoring the movement of the stitching frame in the X-axis direction;

a Y-axis motor for moving the stitching frame in the Y-axis direction;

a Y-axis encoder for monitoring the movement of the stitching frame in the Y-axis direction;

a counter for receiving signals from said encoders to determine the actual position of the stitching frame;

a memory unit for receiving and storing target data to control the movement of the stitching frame; and a processing unit for repetitiously comparing the actual position of the stitching frame determined by the counter and the target position of the frame determined from the target data in the memory unit throughout the stitching of the material, said processing unit permitting the stitching operation to continuously run so long as the comparison continues to show the actual position of the stitching frame corresponds with the target position of the stitching frame, and said processing unit interrupting said stitching of the material upon a comparison which shows that the actual position of the stitching frame does not correspond with the target position of the stitching frame.

7. A sewing machine as set forth in claim 6, wherein said processing unit further selectively calculates the difference between the actual position of the stitching frame as indicated by the counter and the target position of the stitching frame as indicated by the target data in the memory unit and thereby corrects the target data in accordance with the calculated difference, so that the stitching frame can be accurately positioned.

8. A sewing machine as set forth in claim 7, which further includes an X-axis home switch and a Y-axis home switch as reference points for the stitching frame in the X-axis and Y-axis directions, respectively.

9. A sewing machine as set forth in claim 6, which further includes an X-axis home switch and a Y-axis home switch as reference points for the stitching frame in the X-axis and Y-axis directions, respectively.

10. A process for controlling the movement of a stitching frame of a sewing machine during a stitching operation, said process comprising:

sensing the actual position of the stitching frame;

receiving target data from a controller which sets a target position to which the stitching frame is moved;

moving the stitching frame so that the actual position of the stitching frame corresponds to the target position;

comparing the actual position with the target position and repeating the steps of receiving the target data and moving the stitching frame if the actual position corresponds to the target position or interrupting and stopping the stitching operation if the actual position does not correspond to the target position.

11. A process as set forth in claim 10, further including selectively checking the target data with respect to the actual position of the stitching frame and making any necessary corrections to the target data to ensure the accuracy of the stitching operation.

12. A process as set forth in claim 11, further including selectively returning the stitching frame to a home position to serve as a reference point for coordinating the actual position of the stitching frame with the target data.

13. A process as set forth in claim 10, further including selectively returning the stitching frame to a home position to serve as a reference point for coordinating the actual position of the stitching frame with the target data.

14. A process as set forth in claim 13, wherein said process is initialized by returning the stitching frame to said home position and setting the sensed actual position and the target position to a base value.

15. A process as set forth in claim 14, further including selectively checking the target data with respect to the actual position of the stitching frame and making any necessary corrections to the target data to ensure the accuracy of the stitching operation.

* * * * *